US005783975A

United States Patent [19]

Nakamura

[11] Patent Number: 5,783,975

[45] Date of Patent: Jul. 21, 1998

[54] CIRCUIT SELECTION DEVICE

[75] Inventor: Taisuke Nakamura, Tokyo, Japan

[73] Assignee: NEC Corporation, Tokyo, Japan

[21] Appl. No.: 783,870

[22] Filed: Jan. 16, 1997

[30] Foreign Application Priority Data

Jan. 18, 1996 [JP] Japan ..... 8-006538

[51] Int. Cl.[6] ..... H01P 1/10

[52] U.S. Cl. ..... 333/101; 333/104

[58] Field of Search ..... 333/101, 104, 333/105

[56] References Cited

U.S. PATENT DOCUMENTS

| | | | |
|---|---|---|---|
| 2,958,054 | 10/1960 | Concelman | 333/105 |
| 3,694,775 | 9/1972 | Rogers | 333/101 |
| 3,808,566 | 4/1974 | Thompson et al. | 333/101 X |
| 4,556,808 | 12/1985 | Coats | 307/571 |
| 5,274,343 | 12/1993 | Russell et al. | 333/104 X |

FOREIGN PATENT DOCUMENTS

| | | | |
|---|---|---|---|
| 4-32301 | 2/1992 | Japan . | |
| 801062 | 9/1958 | United Kingdom | 333/101 |
| WO 87/00696 | 1/1987 | WIPO . | |

OTHER PUBLICATIONS

U. Tajima et al., "Broadband GaAs FET 2×1 switches", IEEE Gallium Arsenide Integrated Circuit Symposium–Technical Digest, pp. 81–84, (1984).

*Primary Examiner*—Paul Gensler

*Attorney, Agent, or Firm*—Scully, Scott Murphy and Presser

[57] ABSTRACT

A circuit selection device includes a first terminal, a plurality of transmission lines, a plurality of second terminals, a plurality of loads for impedance matching, and a plurality of switches. An RF signal is input/output to/from the first terminal. Each transmission line has one end connected to the first terminal. Each of the second terminals is arranged in correspondence with the other end of each of the transmission lines to selectively input/output an RF signal input/output to/from the first terminal. Each load is arranged in correspondence with the other end of each of the transmission lines. Each switch is switched/connected to one of the second terminal and the load which correspond to the other end of each of the transmission lines. When one of the switches is switched to the second terminal side, the remaining switches are switched to the load side.

7 Claims, 5 Drawing Sheets

CIRCUIT SELECTION DEVICE

BACKGROUND OF THE INVENTION

The present invention relates to an RF circuit and, more particularly, to a device for selecting one of a plurality of RF signal circuits in a mobile radio telephone set.

As prior art, a phase shifter based on a line length switching scheme of switching two transmission lines having different line lengths by using a switch is described in Japanese Patent Laid-Open No. 4-32301. This phase shifter includes first and second transmission lines which have a predetermined line length difference and each of which has one end connected to an input terminal and the other end connected to an output terminal, and a switch which switches between the OFF state and the ON state. In the ON state, the switch is connected to predetermined positions on the first and second transmission lines such that an open-circuit impedance value appears when viewed from the input and output terminals. The phase shifter having such an arrangement switches the transmission lines through which radio waves pass by switching the switch between the ON state and the OFF state, thereby changing the phases of the radio waves. The switch to be used may be constituted by a plurality of two-way switches or one multi-way switch.

The above prior art is a phase shifter for changing a phase. This phase shifter has constituent elements similar to those of a circuit selection device, but has no circuit selecting function.

When a circuit selection device is constituted by a plurality of two-way switches, an input signal must pass through the switches until it reaches the output terminal. With an increase in the number of circuits which can be selected, an input signal passes through a larger number of switches. As a result, the overall insertion loss of the switching device increases.

Assume a circuit selection device is constituted by a multi-way switch. A general multi-way switch currently on the market tends to have a large insertion loss, and is expensive. If the insertion loss of the switch of the circuit selection device can be minimized, the gains of other circuits need not be increased. For this reason, the device is required to suppress the insertion loss.

SUMMARY OF THE INVENTION

It is an object of the present invention to provide a circuit selection device which can prevent an impedance mismatch in an RF band.

It is another object of the present invention to provide a circuit selection device which minimizes the overall insertion loss of the switches of the device.

In order to achieve the above objects, according to the present invention, there is provided a circuit selection device comprising a first terminal to/from which an RF signal is input/output, a plurality of transmission lines each having one end connected to the first terminal, a plurality of second terminals each arranged in correspondence with the other end of each of the transmission lines to selectively input/output an RF signal input/output to/from the first terminal, a plurality of loads for impedance matching, each of the loads being arranged in correspondence with the other end of each of the transmission lines, and a plurality of switches each switched/connected to one of the second terminal and the load which correspond to the other end of each of the transmission lines, wherein when one of the switches is switched to a second terminal side, the remaining switches are switched to a load side.

DESCRIPTION OF THE PREFERRED EMBODIMENTS

The present invention will be described in detail with reference to the accompanying drawings.

Figure 1:
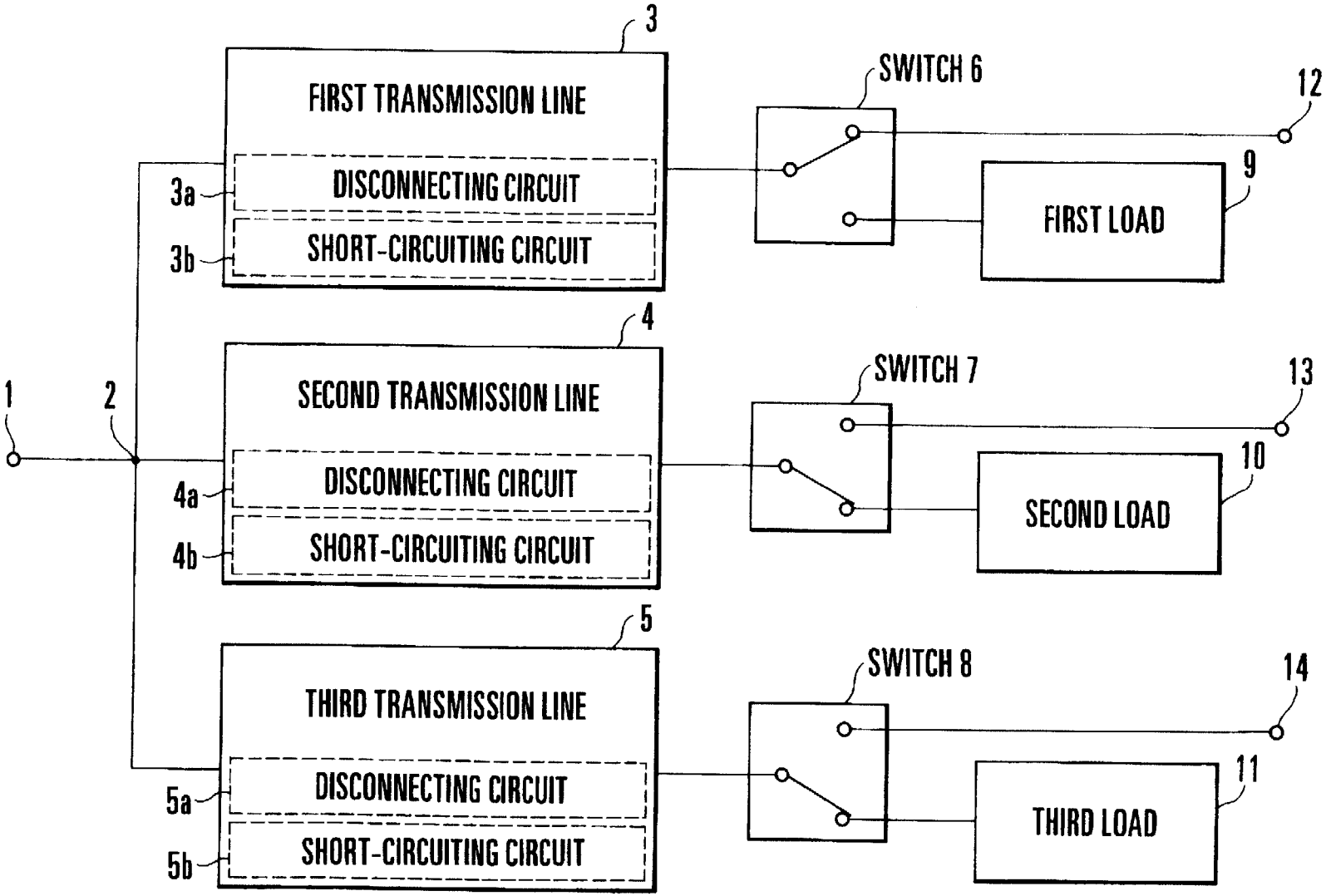
FIG. 1 is a block diagram showing a circuit selection device according to the first embodiment of the present invention.

FIG. 1 shows a circuit selection device according to the first embodiment of the present invention and explains the principle of the circuit selection device. Referring to FIG. 1, an input terminal 1 is connected to one end of each of a first transmission line 3, a second transmission line 4, and a third transmission line 5 through a node 2. The other end of the first transmission line 3 is connected to the input terminal of a switch 6. The first output terminal of the switch 6 is connected to a first output terminal 12. The second output terminal of the switch 6 is connected to a first load 9.

The other end of the second transmission line 4 is connected to the input side of a switch 7. The first output side of the switch 7 is connected to a second output terminal 13. The second output side of the switch 7 is connected to a second load 10. The other end of the third transmission line 5 is connected to the input side of a switch 8. The first output side of the switch 8 is connected to a third output terminal 14. The second output side of the switch 8 is connected to a third load 11.

The first, second, and third transmission lines 3 to 5 have the same line length. The first, second, and third loads 9 to 11 have the same impedance. Reference numerals 3*a*, 4*a*, and 5*a* denote disconnecting circuits for disconnecting the first, second, and third loads 9 to 11 in accordance with line lengths; and 3*b*, 4*b*, and 5*b*, short-circuiting circuits for open-/short-circuiting the first, second, and third loads in accordance with line lengths.

The operation of the circuit selection device having the above arrangement will be described next. When an RF signal is to be passed from the input terminal 1 to the first output terminal 12, the switch 6 is switched to the first output terminal 12 side. Meanwhile, the second output terminal 13 and the third output terminal 14 are switched to the second load 10 side and the third load 11 side.

The line length of the second transmission line 4 and the impedance of the second load 10 are determined such that an open-circuit impedance is set at the signal frequency between the second transmission line 4 and the second load 10 when viewed from the node 2. When, for example, the line length of the second transmission line 4 corresponds to ½ the wavelength, it suffices if the second load 10 is disconnected by the disconnecting circuit 4*a*. When the line length of the second transmission line 4 corresponds to ¼ the wavelength, it suffices if the second load 10 is short-circuited by the short-circuiting circuit 4*b*.

Similarly, an open-circuit impedance is set at the signal frequency between the third transmission line 5 and the load 11, when viewed from the node 2, by the disconnecting circuit 5a or the short-circuiting circuit 5b. In addition, when the line length of the second transmission line 4 is to be decreased in consideration of a mounting area or the like, it suffices if the line length of the second transmission line 4 is determined to set an open-circuit impedance, when viewed from the node 2, by using the inductance of the second load 10.

Figure 2:
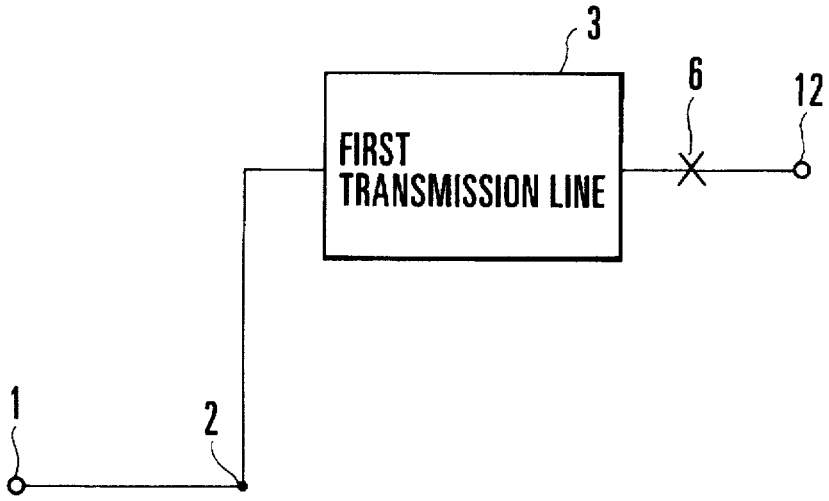
FIG. 2 is an equivalent circuit diagram of FIG. 1 when a first output terminal is selected.

FIG. 2 shows this state. In the arrangement shown in FIG. 1, the second transmission line 4 and the third transmission line 5 are connected to the node 2. However, since each impedance is an open-circuit impedance when viewed from the node 2, FIG. 2 does not show the second and third transmission lines 4 and 5. Referring to FIG. 2, an RF signal is output from the input terminal 1 to the first output terminal 12 through the first transmission line 3 and the switch 6. If the impedances connected to the input terminal 1 and the first to third output terminals 12 to 14 are equal, no impedance mismatch occurs.

Referring to FIG. 1, when an RF signal input to the input terminal 1 is to be output to the output terminal 13, the second switch 7 is switched to the output terminal 13 side, and the first and third switches 6 and 8 are respectively switched to the first load 9 side and the third load 11 side. The operation principle is the same as in the case wherein an RF signal is output to the first output terminal 12.

According to this embodiment, when a switch connected to an output terminal to which a signal is to be output is switched to the output terminal side, the switches connected to the remaining output terminals are switched to the load side. For this reason, since the combined impedance of the transmission lines, the switches, and the signal frequency at the loads is an open-circuit impedance, even if the number of output terminals which can be selected increases, a signal is output to the selected output terminal without causing any mismatch. In addition, since the signal passes through only one switch between the input and output terminals, the insertion loss can be minimized.

Figure 3:
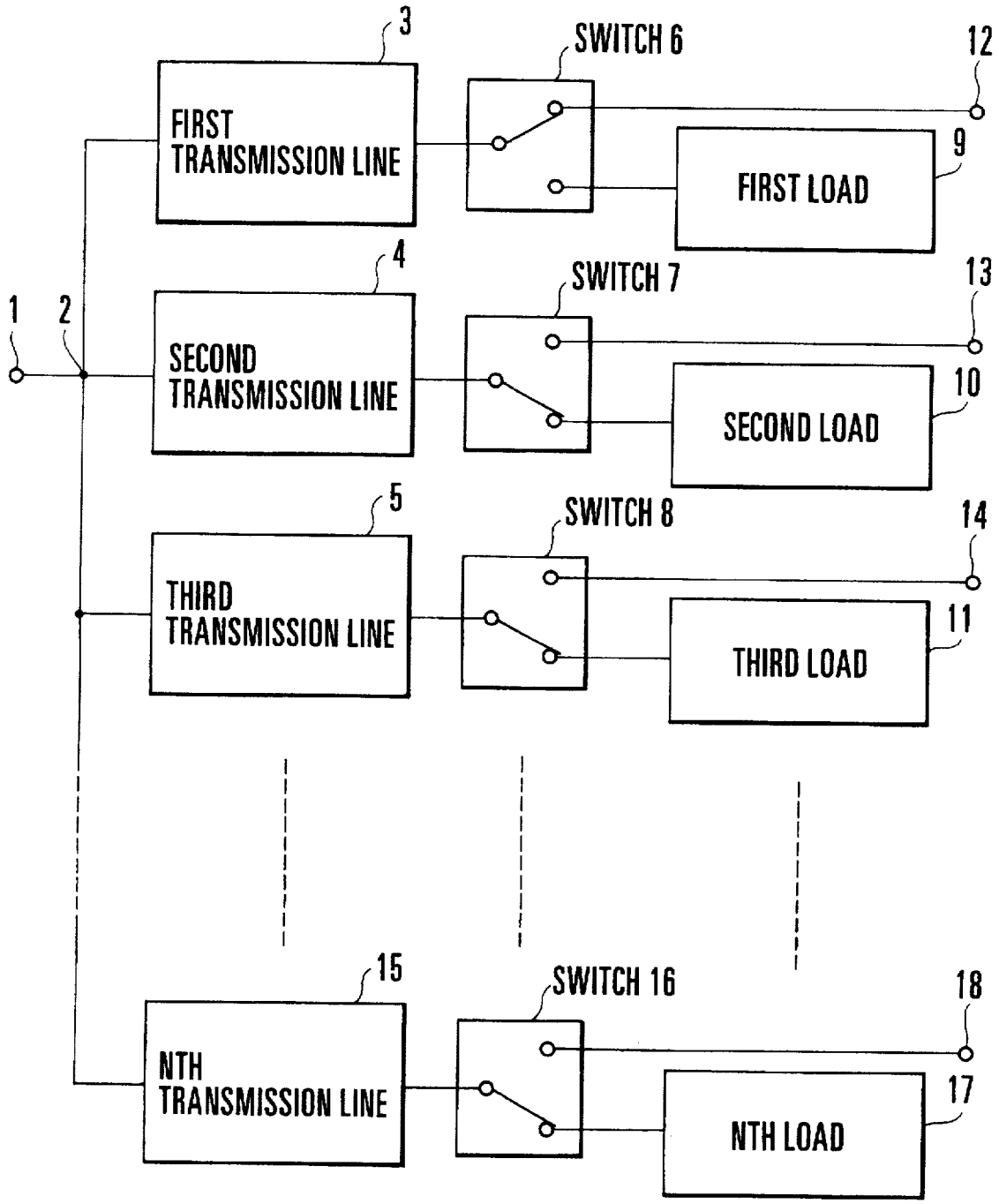
FIG. 3 is a block diagram showing a circuit selection device according to the second embodiment of the present invention.

FIG. 3 shows the second embodiment of the present invention. Although the first embodiment includes three output terminals, the second embodiment includes four or more output terminals. Reference numeral 15 denotes an nth transmission line; 16, an nth switch; 17, an nth load, and 18, an nth output terminal. In this arrangement, similar to the first embodiment, a first switch 6 connected to a first output terminal 12 to which a signal is to be output is switched to the first output terminal 12 side, while all remaining switches 7, 8,. . ., and the switch 16 are switched to loads 10, 11,. . ., and the load 17. Similar to the first embodiment, FIG. 2 shows an equivalent circuit diagram in this state.

Figure 4:
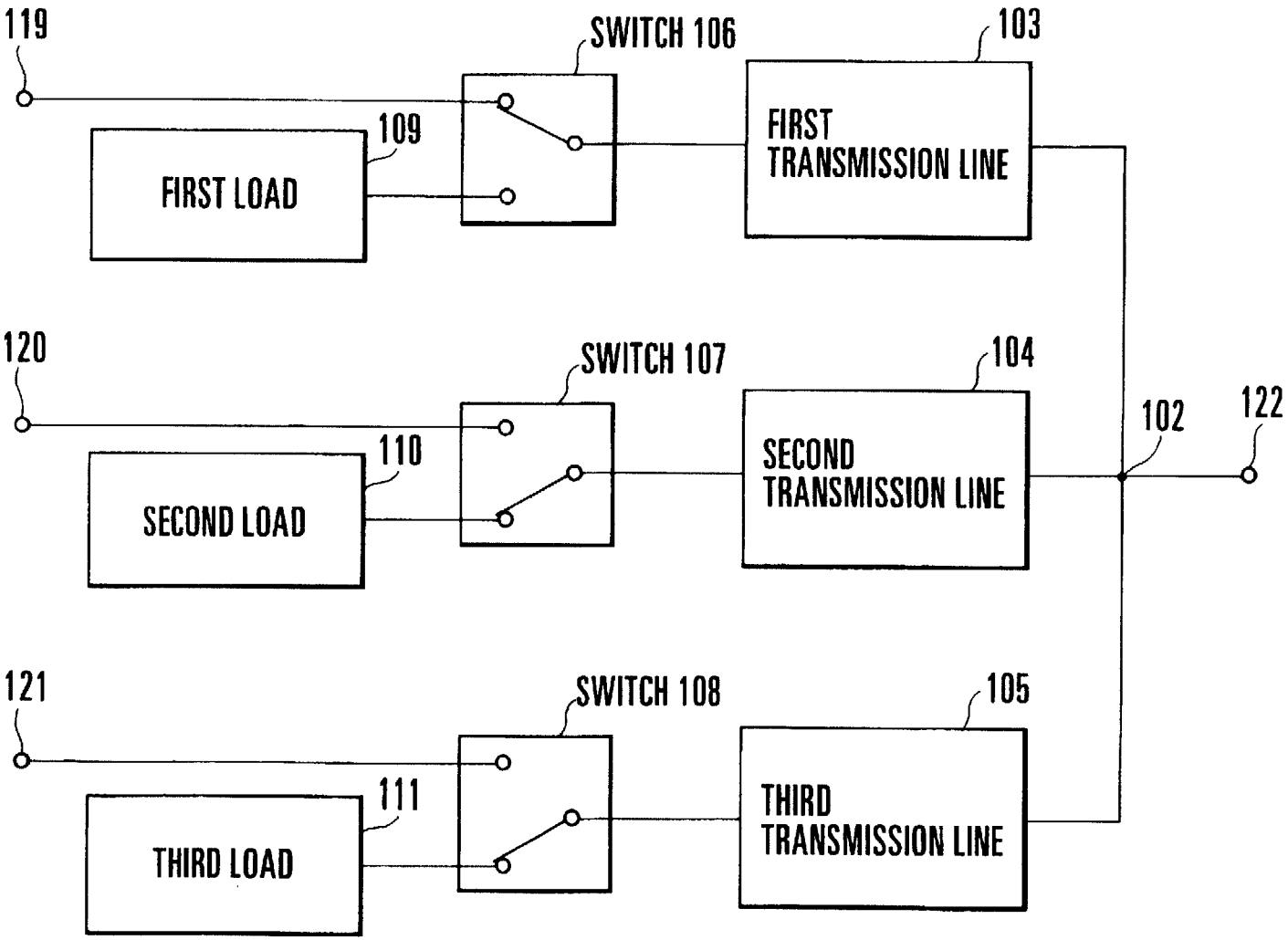
FIG. 4 is a block diagram showing a circuit selection device according to the third embodiment of the present invention.

FIG. 4 shows an arrangement including a plurality of input terminals and one output terminal according to the third embodiment of the present invention. In the embodiment shown in FIG. 4, the position of the input terminal and the positions of the output terminals in FIG. 1 are reversed. More specifically, the first and second input sides of a first switch 106 are respectively connected to a first input terminal 119 and a first load 109. The output side of the first switch 106 is connected to one end of a first transmission line 103. The first and second input sides of a second switch 107 are respectively connected to a second input terminal 120 and a second load 110. The output side of the second switch 107 is connected to one end of a second transmission line 104. The first and second input sides of a third switch 108 are respectively connected to a third input terminal 121 and a third load 111. The output side of the third switch 108 is connected to one end of a third transmission line 105. The other end of each of the first to third transmission lines 103, 104, and 105 is commonly connected to an output terminal 122 through a node 102.

Figure 5:
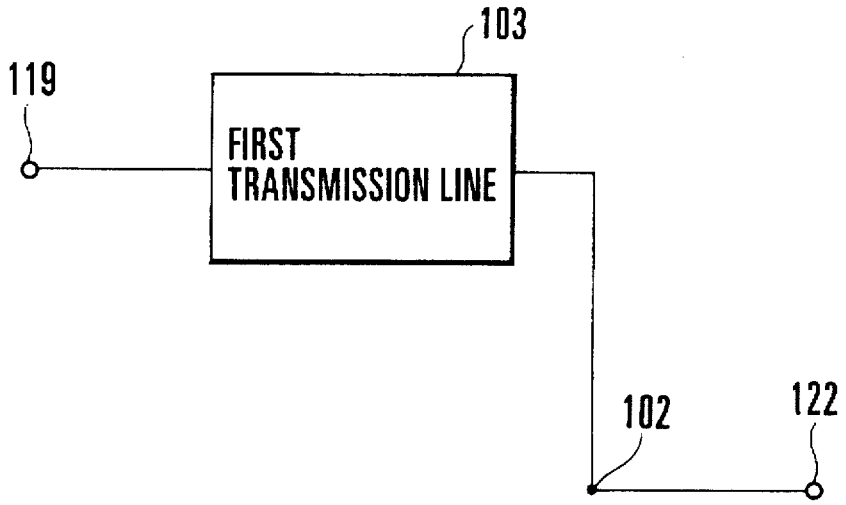
FIG. 5 is an equivalent circuit diagram of FIG. 4 when a first input terminal is selected.

In this arrangement, for example, the first switch 106 connected to the first input terminal 119 to which a signal is to be input is switched to the first input terminal 119 side, while all the remaining switches 107 and 108 are respectively switched to the load 110 side and the load 111 side. FIG. 5 is an equivalent circuit diagram in this state.

As has been described above, according to the circuit selection device of the present invention, when one of a plurality of output terminals (input terminals) is selected, and a signal is to be output (input) thereto, it suffices if a signal passes through one of two-way switches. Therefore, the insertion loss between the input and output terminals can be minimized.

In the circuit selection device of the present invention, even if the number of output terminals (input terminals) increases, when a switch is switched to the load side, the impedance viewed from the node between the transmission line and the load is an open-circuit impedance. For this reason, the characteristics between the input and output terminals are not influenced.

What is claimed is:

1. A circuit selection device comprising:

a first terminal to/from which an RF signal is input/output;

a plurality of transmission lines each having one end connected to said first terminal;

a plurality of second terminals each arranged in correspondence with the other end of each of said transmission lines to selectively input/output an RF signal input/output to/from said first terminal;

a plurality of loads for impedance matching, each of said loads being arranged in correspondence with the other end of each of said transmission lines; and a plurality of switches each connected to the other end of each of said transmission lines and being switched/connected to one of said second terminal and said load which correspond to the other end of each of said transmission lines, wherein when one of said switches is switched to a second terminal side, all of said remaining switches are switched to a load side, and the combined impedance of the transmission lines and the loads at the signal frequency presents an open-circuit impedance when viewed from the first terminal.

2. A device according to claim 1, wherein when one of said switches is switched to the load side, a combined impedance at said remaining transmission lines, said switches, and said loads has an open-circuit impedance value when viewed from said first terminal.

3. A device according to claim 1, wherein said first terminal is an input terminal, and said second terminals are output terminals.

4. A device according to claim 1, wherein said first terminal is an output terminal, and said second terminals are input terminals.

5. A device according to claim 1, wherein said transmission lines comprise a plurality of disconnecting means for, when said transmission line has a line length corresponding to ½ a wavelength of an RF signal, disconnecting said corresponding load.

6. A device according to claim 1, wherein said transmission lines comprise a plurality of short-circuiting means for, when said transmission line has a line length corresponding to ¼ a wavelength of an RF signal, short-circuiting said corresponding load.

7. A circuit selection device according to claim 1, in a mobile radio telephone set wherein the circuit selection device selects one of a plurality of RF signal circuits in the mobile radio telephone set.

* * * * *